US011234519B2

(12) United States Patent
Rahilly et al.

(10) Patent No.: US 11,234,519 B2
(45) Date of Patent: Feb. 1, 2022

(54) CONFIGURABLE CABINET FOR HANGING AND SHELVED ITEMS

(71) Applicant: CareFusion 303, Inc., San Diego, CA (US)

(72) Inventors: Michael Rahilly, Encinitas, CA (US); Jeff Ly, Vista, CA (US)

(73) Assignee: CareFusion 303, Inc., San Diego, CA (US)

( * ) Notice: Subject to any disclaimer, the term of this patent is extended or adjusted under 35 U.S.C. 154(b) by 118 days.

(21) Appl. No.: 14/173,778

(22) Filed: Feb. 5, 2014

(65) Prior Publication Data

US 2014/0152161 A1 Jun. 5, 2014

Related U.S. Application Data

(63) Continuation of application No. 12/828,092, filed on Jun. 30, 2010, now Pat. No. 8,646,855.

(51) Int. Cl.
*A47B 96/06* (2006.01)
*A47B 61/02* (2006.01)

(52) U.S. Cl.
CPC ..... *A47B 96/06* (2013.01); *A47B 61/02* (2013.01); *Y10T 29/49817* (2015.01)

(58) Field of Classification Search
CPC .... A47B 96/06; A47B 61/02; Y10T 29/49817
USPC .... 312/209, 234–234.5, 330.1, 334.1, 334.4, 312/334.5, 298–303, 114, 128–136, 312/334.23; 29/426.2; 211/94.01
See application file for complete search history.

(56) References Cited

U.S. PATENT DOCUMENTS

| | | | | |
|---|---|---|---|---|
| 512,519 A | | 1/1894 | Rey | |
| 701,000 A | * | 5/1902 | Ahrens | |
| 1,132,190 A | | 3/1915 | Kohout | |
| 1,569,158 A | * | 1/1926 | Tobey | A47B 88/43 312/240 |
| 2,594,571 A | * | 4/1952 | Lundberg | A47B 88/43 312/334.4 |
| 2,639,042 A | * | 5/1953 | Lambert | A47B 57/50 211/208 |
| 2,658,627 A | * | 11/1953 | Magnuson | A47G 25/1414 211/113 |

(Continued)

OTHER PUBLICATIONS

"Product Specifications," Stanley InnerSpace, last viewed Jul. 1, 2010, retrieved from <http://www.innerspacecorp.com>.

*Primary Examiner* — Daniel J Troy
*Assistant Examiner* — Timothy M Ayres
(74) *Attorney, Agent, or Firm* — Morgan, Lewis & Bockius LLP

(57) ABSTRACT

In certain embodiments of the present disclosure, a cabinet is provided. The cabinet includes a plurality of drawer slide receiving modules and a plurality of hanging drawer slides, each hanging drawer slide coupled to one of the plurality of drawer slide receiving modules, and each hanging drawer slide includes a plurality of hooks of a first type. At least one of the hanging drawer slides is configured to be withdrawn from the cabinet laterally along a longest axis of the hanging drawer slide. The plurality of drawer slide receiving modules are configured to be removably coupled to the cabinet in a plurality of different configurations. Methods and configuration systems are also provided.

15 Claims, 8 Drawing Sheets

(56) References Cited

U.S. PATENT DOCUMENTS 2,686,704 A * 8/1954 Wolters ..... A47B 47/03 312/257.1
3,256,709 A 6/1966 Stepleton
3,341,270 A * 9/1967 Sohl ..... A47B 57/18 312/306
3,771,849 A * 11/1973 Barber ..... A47B 88/43 312/350
3,794,182 A 2/1974 Royeton
3,848,942 A * 11/1974 Fanini ..... A47B 47/042 312/265.5
3,954,182 A 5/1976 McEvers
4,019,638 A 4/1977 Miller
4,045,899 A * 9/1977 Richardson ..... A47G 25/1428 116/200
4,111,341 A * 9/1978 Carrozo ..... A45C 13/02 206/227
4,137,661 A * 2/1979 Johansson ..... G09F 3/04 40/322
4,137,740 A * 2/1979 Eckerdt ..... A44B 15/005 70/456 R
4,193,649 A * 3/1980 Sharon ..... A47B 88/407 248/243
4,209,156 A 6/1980 Kashden
4,550,246 A * 10/1985 Markman ..... G06Q 10/087 235/383
4,681,381 A * 7/1987 Sevey ..... A47B 88/43 312/333
4,869,379 A 9/1989 Hawkrige
4,928,833 A 5/1990 Huizenga
5,076,442 A 12/1991 Hakeem
5,160,048 A 11/1992 Leyden et al.
5,209,572 A * 5/1993 Jordan ..... A47B 88/493 312/334.7
5,337,905 A 8/1994 Gast
D353,943 S 1/1995 Varin
5,466,060 A * 11/1995 Hoffman ..... A47B 88/493 312/334.11
5,470,143 A * 11/1995 Gill ..... A47B 88/43 292/18
5,553,936 A * 9/1996 Dasher ..... A47B 57/06 248/243
5,762,213 A * 6/1998 Heneveld, Sr. ..... A47B 57/485 211/187
5,785,401 A * 7/1998 Bowyer ..... A47B 88/43 108/110
5,790,409 A * 8/1998 Fedor ..... G06M 7/04 700/214
5,805,456 A * 9/1998 Higham ..... G07F 17/0092 312/215
5,809,470 A * 9/1998 Monjo ..... G06K 19/04 223/85
5,812,986 A * 9/1998 Danelski ..... G06F 3/147 705/22
5,962,834 A * 10/1999 Markman ..... A47G 25/1428 235/385
6,619,772 B2 * 9/2003 Dierbeck ..... B25H 3/028 312/334.1
6,650,225 B2 * 11/2003 Bastian, II ..... G06F 3/147 340/5.9
6,659,576 B1 12/2003 Welch
6,762,681 B1 * 7/2004 Danelski ..... B65G 1/137 340/5.2
6,840,590 B2 * 1/2005 Hightower ..... A47B 88/43 312/249.4
7,596,427 B1 * 9/2009 Frederick ..... G06Q 10/06 312/209
7,841,495 B2 * 11/2010 Gouldson ..... A47G 25/1414 223/85
8,373,542 B2 * 2/2013 Lee ..... G08B 13/2402 235/385
9,295,327 B2 * 3/2016 Erickson ..... A47B 88/57
9,386,847 B1 * 7/2016 Jeffries ..... A47B 47/024
2004/0182801 A1 9/2004 Sedon et al.
2006/0225593 A1 * 10/2006 Flynn ..... G09F 23/06 101/483
2007/0262683 A1 11/2007 Creed
2008/0078201 A1 4/2008 Olefson
2008/0149711 A1 * 6/2008 Griffits ..... E05B 17/103 235/385
2009/0145868 A1 * 6/2009 Schneuing ..... A47G 25/1442 211/113
2009/0224875 A1 * 9/2009 Rabinowitz ..... A45C 13/18 340/5.53
2010/0122963 A1 5/2010 Costa et al.
2010/0277321 A1 * 11/2010 McElwaine ..... G06K 7/0008 340/572.1
2011/0179681 A1 * 7/2011 Larners ..... A47G 25/1428 40/322
2012/0013235 A1 * 1/2012 Hisamatsu ..... G07F 19/205 312/334.7
2012/0278228 A1 * 11/2012 Rubinstein ..... G07G 1/009 705/39

* cited by examiner

CONFIGURABLE CABINET FOR HANGING AND SHELVED ITEMS

CROSS REFERENCE TO RELATED APPLICATIONS

The present application claims the benefit of priority under 35 USC. § 120 as a continuation from U.S. patent application Ser. No. 12/828,092, entitled "Configurable Cabinet for Hanging and Shelved Items," filed on Jun. 30, 2010, the disclosure of which is hereby incorporated by reference in its entirety for all purposes.

BACKGROUND

Field

The present disclosure generally relates to cabinet systems, and specifically to a configurable cabinet for storing various types and sizes of hanging and shelved items.

Description of the Related Art

It is well known that cabinets are used for storing supply items. In the medical field, supply cabinets are often used to store hanging item types, such as catheters, and shelved item types, such as stems. These items often come in packages of various sizes and shapes, and in certain cases the packages cannot be bent without negatively impacting the items' structural and functional integrity. As a result, cabinets are often preconfigured to store items of many shapes and sizes by simply being configured to accommodate items of the largest shape and size, thereby wasting valuable space when items having a smaller shape or size are stored. This results in fewer items being stored in the cabinet ("decreased item density"). In many cases, the cabinets are also preconfigured to store nuns of only one type (e.g., hanging items), so the are unable to store items of another type (e.g., shelved items), which also results in decreased item density and flexibility.

SUMMARY

The cabinets disclosed herein, according to certain embodiments, are configurable to store items, including hanging items and shelved items, based on their various types and sizes. The cabinets include drawer slide receiving modules that can be positioned and re-positioned within the cabinet based on the type and size of the items they are meant to store. As a result, the disclosed cabinets increase item density. The disclosed cabinets allow hanging items and shelved items to be stored within the same cabinet as other supply items. The disclosed cabinets are further field retro-fittable, e.g., they can be reconfigured while in use in order to accommodate new sizes and types of items.

In certain embodiments of the present disclosure, a cabinet is disclosed. The cabinet includes a plurality of drawer slide receiving modules and a plurality of hanging drawer slides, each hanging drawer slide coupled to one of the plurality of drawer slide receiving modules, and each hanging drawer slide includes a plurality of hooks of a first type. At least one of the hanging drawer slides is configured to be withdrawn from die cabinet in a perpendicular direction along a horizontal axis of the hanging drawer slide. The plurality of drawer slide receiving, modules are configured to be removably coupled to the cabinet, in a plurality of different configurations.

In certain embodiments of the present disclosure, a method for configuring a cabinet is disclosed. The method includes coupling a plurality of drawer slide receiving modules to the cabinet by coupling at least one projection of each drawer slide receiving module with a corresponding hole in the cabinet. The method also includes coupling, in a first configuration, a plurality of hanging drawer slides to the plurality of drawer slide receiving modules, each hanging drawer slide coupled to one of the plurality of drawer slide receiving modules, each hanging drawer slide includes a plurality of hooks of a first type. The method further includes withdrawing, the shelf drawer slide in a perpendicular direction from the cabinet along a horizontal axis, uncoupling at least one of the plurality of hanging drawer slides from at least one of the plurality of drawer slide receiving modules, and coupling, in a second configuration, the at least one of the plurality of hanging drawer slides to another of the plurality of drawer slide receiving modules. The plurality of drawer slide receiving modules are configured to be removably coupled to the cabinet in a plurality of different configurations.

In certain embodiments of the present disclosure, a configuration system is disclosed. The configuration system includes a plurality of drawer slide receiving modules, and a plurality of hanging drawer slides, each hanging drawer slide coupled to one of the plurality of drawer slide receiving modules, each hanging drawer slide includes a plurality of hooks of a first type. At least one of the hanging drawer slides is configured to be withdrawn from the plurality of drawer slide receiving modules laterally along, a horizontal axis of the hanging drawer slide. The plurality of drawer slide receiving modules are configured to be removably coupled to the cabinet in a plurality of different configurations.

BRIEF DESCRIPTION OF THE DRAWINGS

The accompanying, drawings, which are included to provide further understanding and are incorporated in and constitute a part of this specification, illustrate disclosed embodiments and together with the description serve to explain the principles of the disclosed embodiments. In the drawings.

DETAILED DESCRIPTION

In the following detailed description, numerous specific details are set forth to provide a full understanding of the present disclosure. It will be obvious, however, to one ordinarily skilled in the art that the embodiments of the present disclosure may be practiced without some of these specific details. In other instances, well-known structures and techniques have not been shown in detail so as not to obscure the disclosure.

Figure 1:
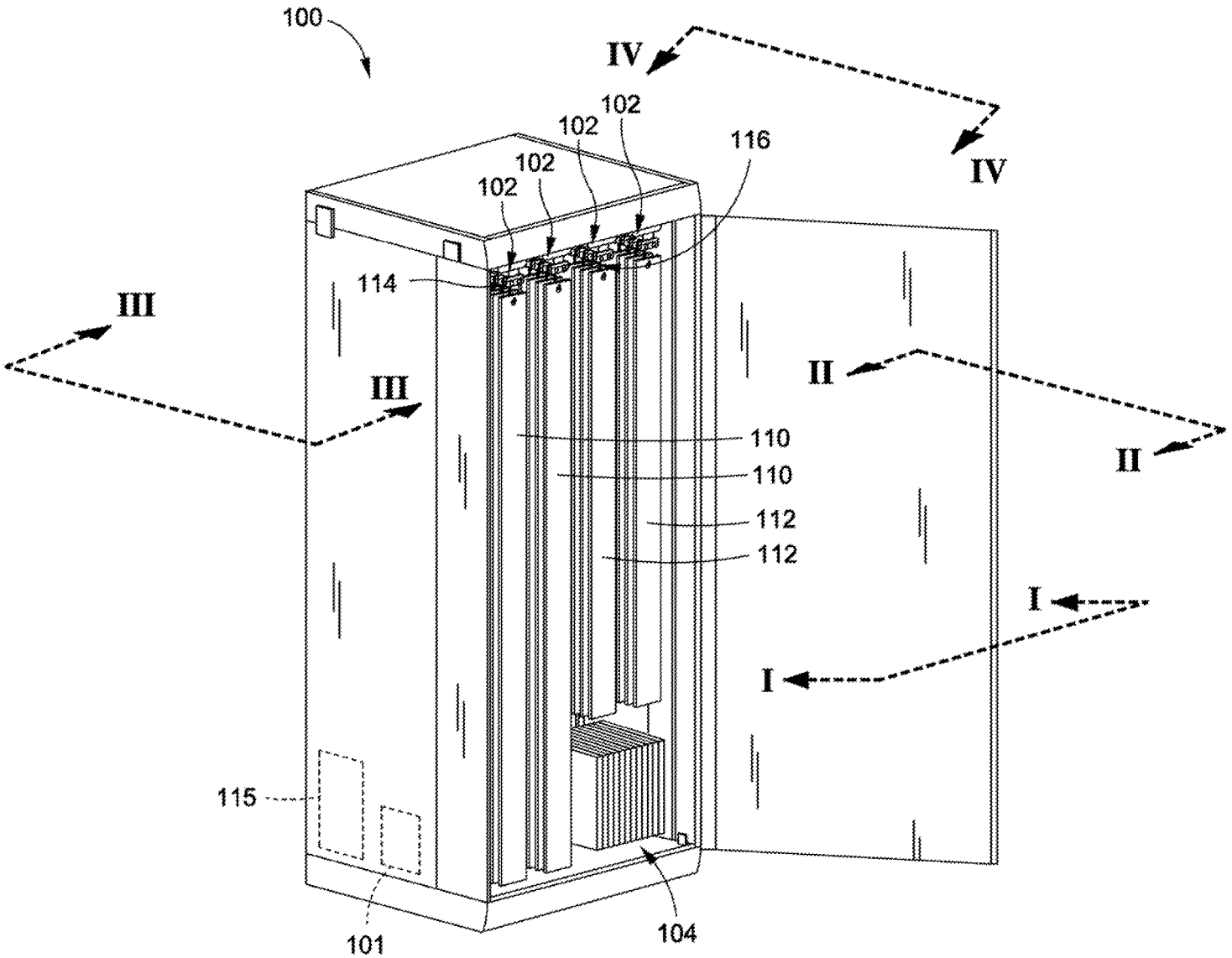
FIG. 1 illustrates a cabinet in a first configuration according to certain embodiments.

Referring now to the drawings, FIG. 1 illustrates a reconfigurable cabinet 100 in a first configuration according to certain embodiments. The cabinet 100 is used for the storage and dispensing of hanging items 110 and 112, such as medical items, and items configured to be stored in a shelf drawer slide 104, and the cabinet 100 is reconfigurable based on the size and types of items being stored. In certain, embodiments, the cabinet 100 is about 21" wide by 24.7" deep by 75' high.

Figure 2B:
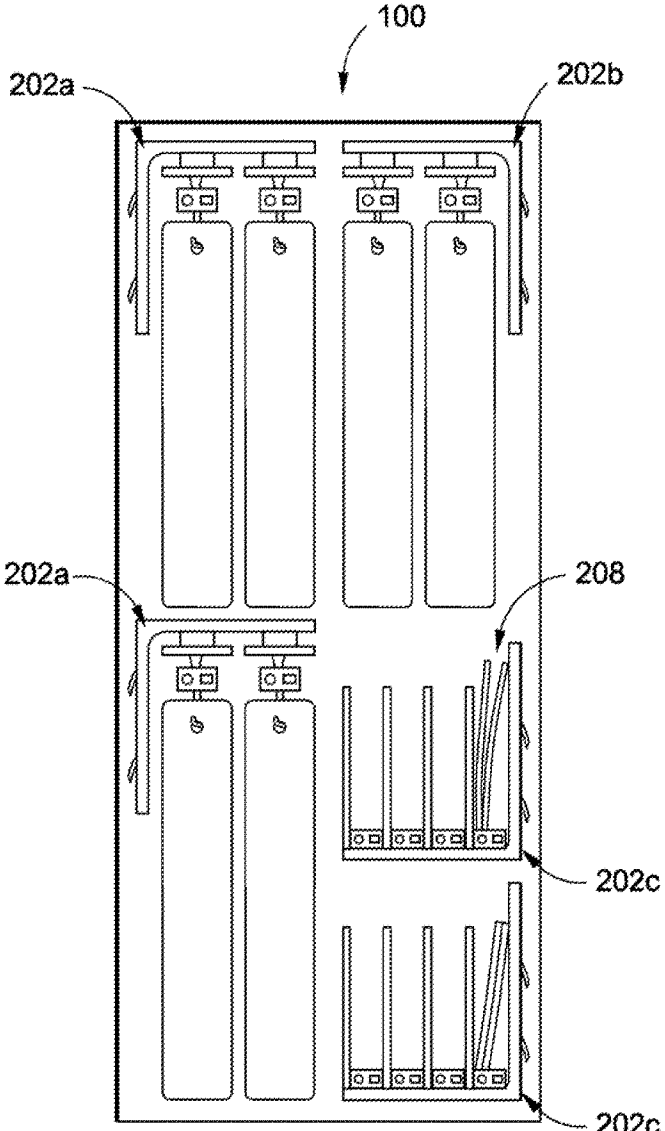
FIG. 2B is a front view of the cabinet of FIG. 1 in a second configuration in the direction of arrow I-I of FIG.
Figure 2A:
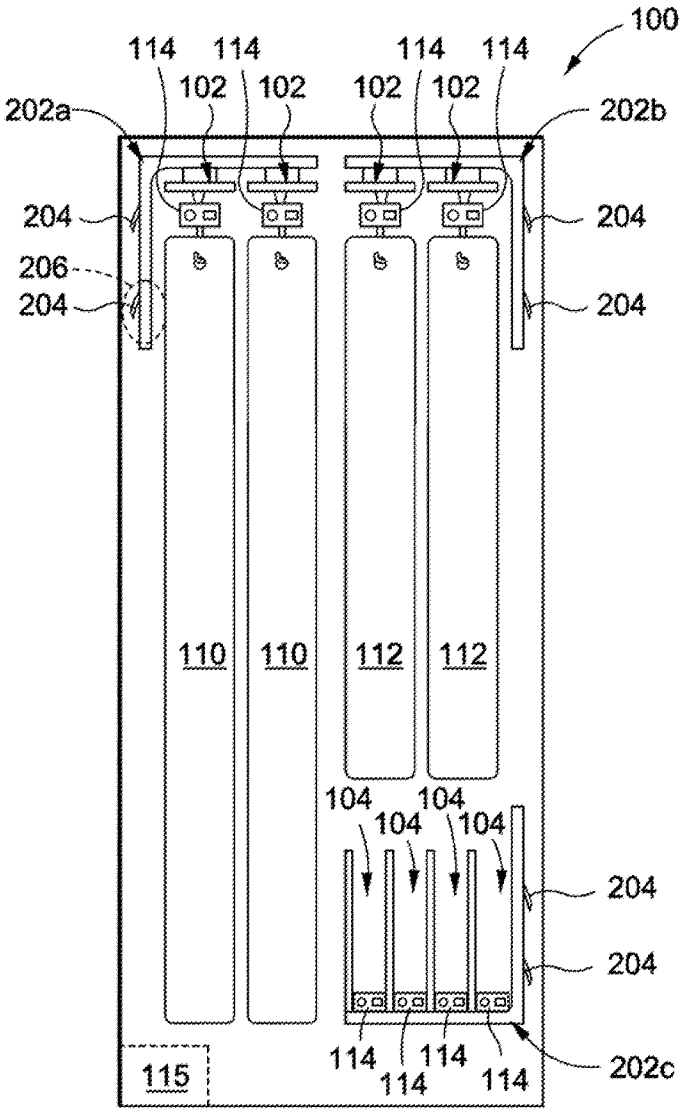
FIG. 2A is a front view of the cabinet of FIG. 1 in the direction of arrow I-I of FIG. 1.

As illustrated in FIG. 1, the cabinet includes a configuration of both hanging drawer slides 102 and a shelf drawer slide 104, each of which are coupled to drawer slide receiving modules 202*a*, 202*b*, and 202*c* (illustrated in FIG. 2A). The hanging drawer slides 102 are coupled to hooks 116 upon which hanging items 110 and 112 reside. In certain embodiments, other types of hooks 116 can be used, such as the hooks 116 illustrated in FIGS. 4B and 6A-6D. The illustrated items 110 and 112 are of various sizes, for example, the larger hanging items 110 are catheters with a vacuum package size of about 4" by 63", and the smaller hanging items 112 are catheters with a package size of about 4" by 48". In certain embodiments, hanging items 110 and 112 are packaged in slender cardboard boxes having a size of about 4" by 2" by 63". As discussed above, the cabinet 100 is advantageously configured to store item packages 110 and 112, such as the catheters, that cannot be bent during storage in order to maintain their structural and functional integrity.

The shelf drawer slide 104 is configured to hold shelved items, such as stents (208 in FIG. 2B). The shelved items are, for example, 10" coiled stent packs. The items can be stored in the shelf drawer slide 104 in various configurations, such as in a stacked or side-by-side configuration. In certain embodiments, as shelf drawer slide 104 includes re-configurable dividers for dividing the area enclosed within the shelf drawer slide 104.

in certain embodiments, an item inventory device 114, such as the Pyxis® JITrBUD by CareFusion, is coupled to a hanging drawer slide 102 and/or a shelf drawer slide 104. In certain embodiments, the item inventory device 114 includes a visual indicator, such as an LED, to indicate where an item is located, when a button is depressed, or when the battery is low. In certain embodiments, the item inventory device 114 uses manual input from a user to track whether an item 110 or 112 has been dispensed or added, such as by the user pressing a button on the item inventor device 114 to indicate whether one of the items 110 or 112 has been dispensed or added. The item inventory device 114 can be shared among several hanging drawer slides 102 and shelf drawer slides 104 (and placed in a shared location), or can be individually assigned to each hanging drawer slide 102 and shelf drawer slide 104. In certain embodiments, the item inventory device 104 is physically coupled to a hanging drawer slide 102 and/or a shelf drawer slide 104 by snap-on mounting.

In certain embodiments, the cabinet 100 includes an inventory tracking device 115, such as a radio frequency identification (RFD) antenna. For example, if an item 110, 112, or 208 is associated with its own RHO tag, for purposes of item tracking, the inventory tracking device 115 is configured to detect REID tags within and/or near the cabinet, and, using a processor 101, determine an inventory of items 110, 112, or 208 in the cabinet 100. The processor 101 can be a stand-alone processor with input/output devices for interaction with a user, and/or can be directly coupled to a network and a central processor (not shown) that can track and/or manage the inventory and supply of items.

As will be discussed with reference to FIGS. 4A-4D, the hanging drawer slides 102 are configured to slide out of the cabinet 100 in a perpendicular direction along a horizontal axis in order to facilitate removal of selected items, and to slide back in to the cabinet 100 after the selected items are removed. In certain embodiments, the shelf drawer slide 104 is also configured to slide out of the cabinet 100 along a horizontal axis in order to facilitate removal of selected items, and to slide back in to the cabinet 100 after the selected items are removed.

Figure 2C:
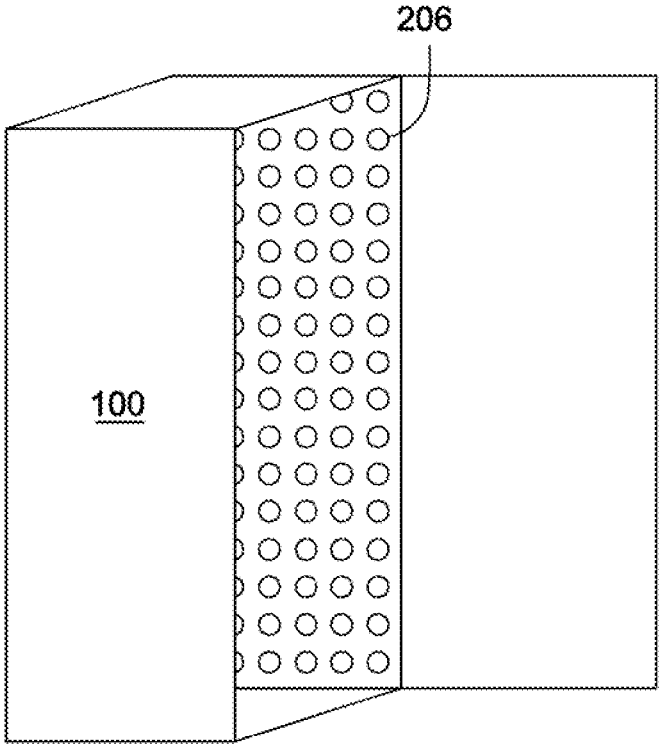
FIG. 2C is a view of the cabinet of FIG. 1 in an empty configuration it the direction of arrow III-III of FIG. 1.

FIG. 2A is a front view of the cabinet 100 of FIG. 1 in the direction of arrow I-I of FIG. 1. As more clearly illustrated in FIG. 2A, each hanging drawer slide 102 and shelf drawer slide 104 is coupled to a drawer slide receiving module 202*a*, 202*b*, or 202*c* (referred to generally as 202). The drawer slide receiving modules 202*a*, 202*b*, and 202*c* are configured to couple to the cabinet 100 in certain embodiments, the drawer slide receiving modules 202*a*, 202*b*, and 202*c* are coupled to the cabinet 100 using projections 204 extending away from a surface of the drawer slide receiving modules 202*a*, 202*b*, and 202*c*, and received into corresponding detents or holes 206 in the cabinet 100, one hole 206 of which is illustrated in phantom in FIG. 2A. FIG. 2C, which is a view of the cabinet 100 of FIG. 1 in an empty configuration in the direction of arrow of FIG. 1, illustrates an embodiment of the cabinet 100 in which many detents 206 are available for coupling with drawer slide receiving modules 202 in various positions. The position at which a drawer slide receiving module 202 is coupled with detents 206 in the cabinet 100 can be determined based on the needs of a user. In certain embodiments, other mechanisms well known to those of ordinary skill in the art can be used to couple the drawer slide receiving modules 202 to the cabinet 100, including snap-fit connections, releasable fasteners, etc.

The ability to couple and uncouple drawer slide receiving modules 202 from the cabinet 100 allows the cabinet 100 to include drawer slide receiving modules 202 in a variety of configurations, including both right facing and left facing drawer slide receiving modules 202. For example, the cabinet 100 illustrated in FIG. 2A includes a drawer slide receiving module 202*a*, which is right-facing, and positioned to couple to two hanging drawer slides 102, drawer slide receiving module 202*b*, which is left-facing and positioned to couple to two hanging drawer slides 102, and remaining, drawer slide receiving module 202*c*, which is left-facing and positioned to couple to four shelf drawer slides 104. Alternatively, FIG. 28 illustrates a front view of the cabinet 100 of FIG. 1 in a second configuration in the direction of arrow I-I of FIG. 1, in which the cabinet 100 includes two drawer slide receiving modules 202*a*, which are each right-facing and positioned to couple to two hanging drawer slides 102, one drawer slide receiving module 202*b*, which is left-facing and positioned to couple to two hanging drawer slides 102, and two drawer slide receiving module 202*c*, which are each left-facing and positioned to couple to four shelf drawer slides 104. By way of another example, a cabinet 100 can be configured to include only hanging drawer slides 102 or shelf drawer slides 104. A drawer slide receiving module 202 that is right-facing and positioned to couple to shelf drawer slides 104 can also be used, but is not illustrated.

In certain embodiments, the hanging drawer slides 102 are removably coupled to the drawer slide receiving modules 202*a* and 202*b*, e.g., the hanging drawer slides 102 can be connected to and disconnected from the drawer slide receiving modules 202*a* and 202*b*. For example, the hanging drawer slide 102 of FIGS. 1-4D can be replaced with the hanging drawer slide 502 illustrated in FIG. 5, discussed in greater detail below. In certain embodiments, different numbers of hanging drawer slides 102 and shelf drawer slides 104 are configured to couple to a drawer slide receiving, module 202. For example, in certain embodiments, four hanging drawer slides 102 can couple to a drawer slide receiving module 202. In certain embodiments, one hanging drawer slide 102 can couple to a drawer slide receiving module 202. In certain embodiments, eight shelf drawer slides 104 can couple to a drawer slide receiving module 202. In certain embodiments, one shelf drawer slide 104 can couple to a drawer slide receiving module 202.

Figure 3A:
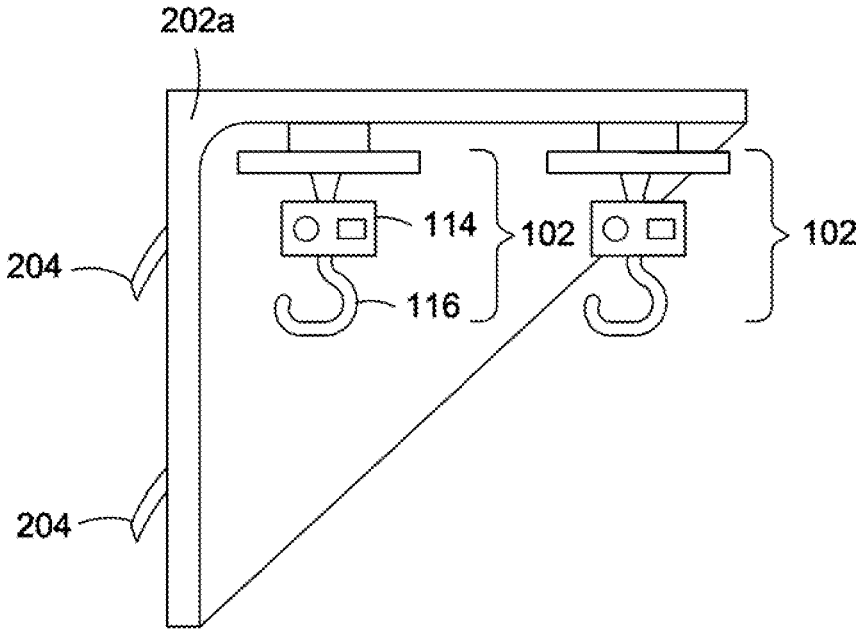
FIG. 3A illustrates, in the direction of arrow I-I of FIG. 1, hanging drawer slides coupled to a drawer slide receiving module for the cabinet of FIG. 1 according to certain embodiments.

FIG. 3A illustrates, in the direction of arrow I-I of FIG. 1, two hanging drawer slides 102 coupled to a drawer slide receiving module 202*a* for the cabinet 100 of FIG. 1 according to certain embodiments. The hanging items 110 and 112 have been removed for purposes of clarity. As discussed above, the hanging drawer slides 102 are coupled to the drawer slide receiving module 202*a* that includes projections 204 for coupling to the cabinet 100. Each of the hooks 116 coupled to each hanging, drawer slide 102 is associated with an item inventory device 114 to track, based on input from a user, whether the item associated with the hook 116 has been dispensed.

Figure 3B:
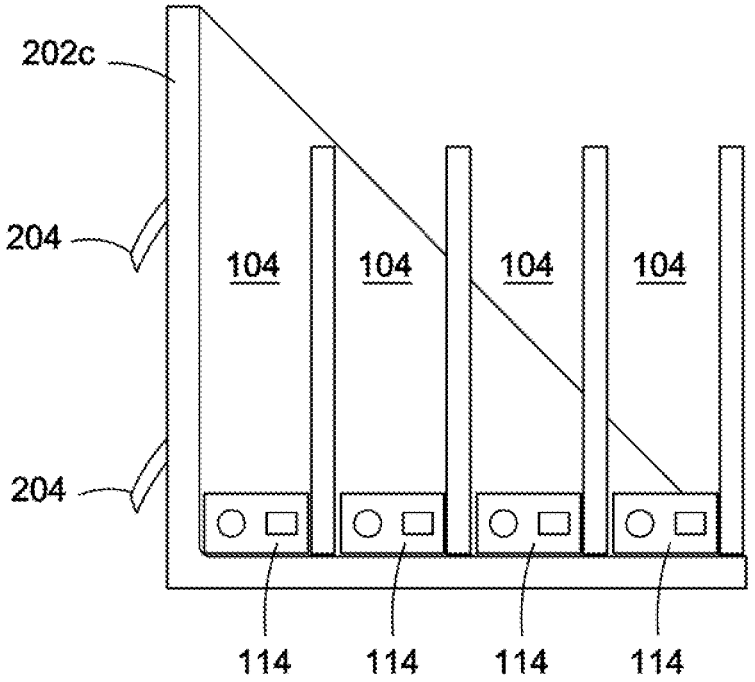
FIG. 3B illustrates shelf drawer slides coupled to a drawer slide receiving module for the cabinet of FIG. 1 according to certain embodiments.

FIG. 3B illustrates four shelf drawer slides 104 coupled to a drawer slide receiving module 202*c* for the cabinet 100 of FIG. 1 according to certain embodiments. As discussed above, the shelf drawer slides 104 are coupled to the drawer slide receiving module 202*c* that includes projections 204 for coupling to the cabinet 100. Each of the shelf drawer slides 104 is associated with an item inventory device 114 to track, based on input from a user, whether the item associated with the shelf drawer slide 104 has been dispensed.

Figure 4A:
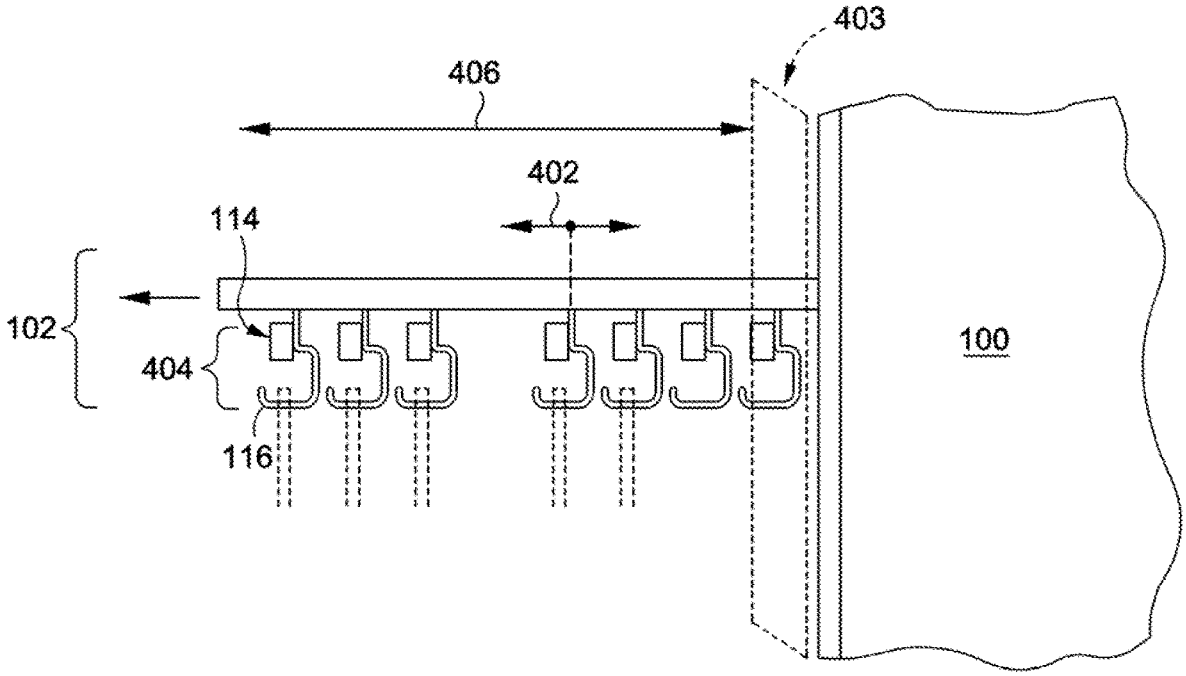
FIGS. 4A-4C, illustrate, in the direction of arrows II-II, III-III, and IV-IV of FIG. 1, respectively, a hanging drawer slide, in various configurations, withdrawn from the cabinet of FIG. 1.
Figure 4B:
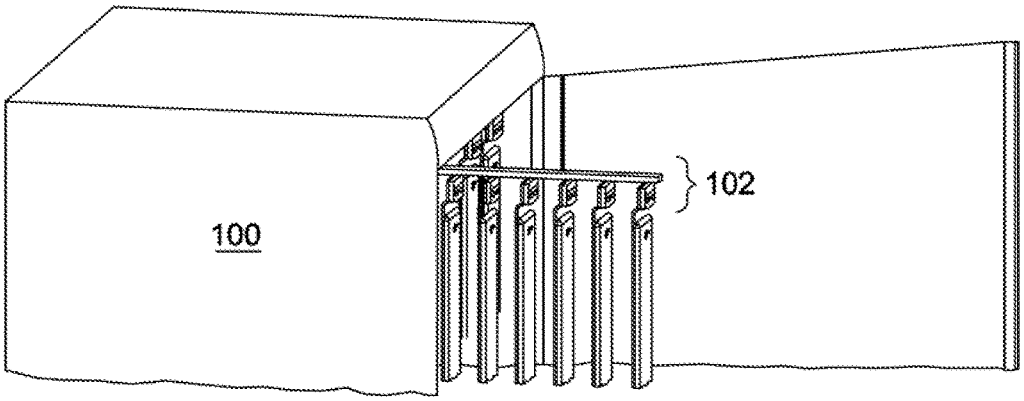
Figure 4C:
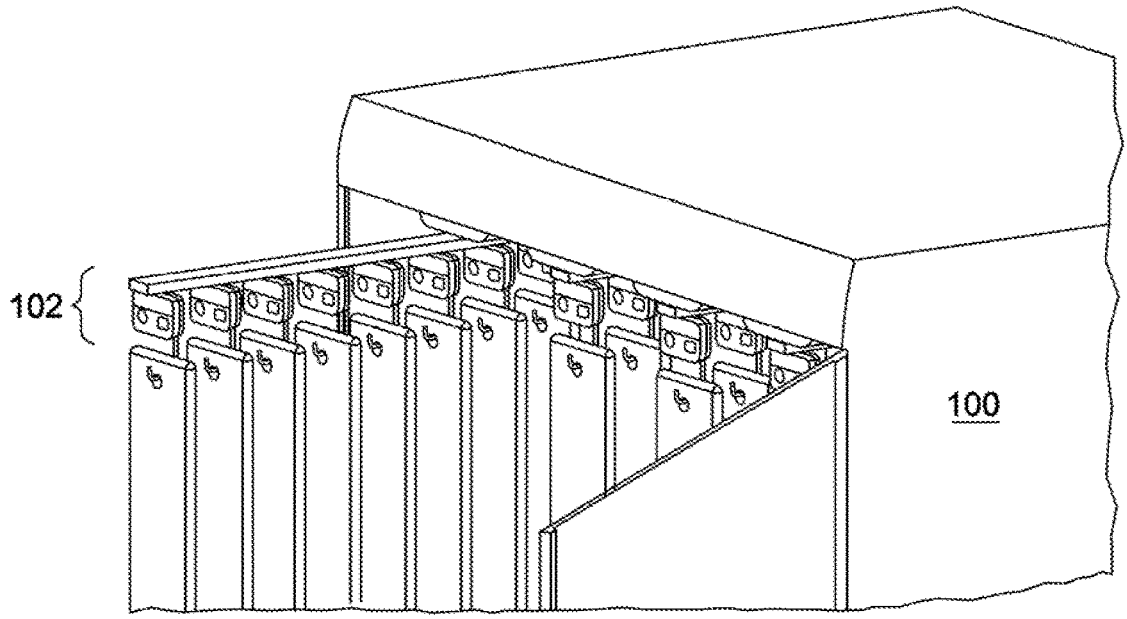

FIGS. 4A-4C illustrate, in the direction of arrows II-II, III-III and IV-IV of FIG. 1, respectively, a hanging drawer slide 102 withdrawn from the cabinet 100. In certain embodiments, the hanging drawer slide 102 is configured to be withdrawn from the cabinet 100 laterally along a horizontal axis of the hanging, drawer slide 102, illustrated as arrow 406, that is perpendicular to the opening plane 403 of the cabinet 100. Allowing the hanging drawer slide 102 to withdraw from the cabinet 100 facilitates access to each hanging item 110 and to each associated item inventory device 114. In certain embodiments, a hook assembly 404, which includes a hook 116 and item inventory device 114, is configured to be removed from the hanging drawer slide 102 in order to create additional space, such as to accommodate additional items and/or items of different sizes. The illustrated hook assembly 404 is configured for hanging a single item 110. A conventional sliding mechanism can be used to provide the sliding movement of the hanging drawer slide 102. In certain embodiments, each hook assembly 404 is configured to slide laterally along a horizontal axis 402 of the hanging drawer slide 102 that is perpendicular to the opening plane 403 of the cabinet 100. Allowing the hook assembly 404 to slide in either direction facilitates access to each hanging item 110 and to each associated item inventory device 114.

Figure 4D:
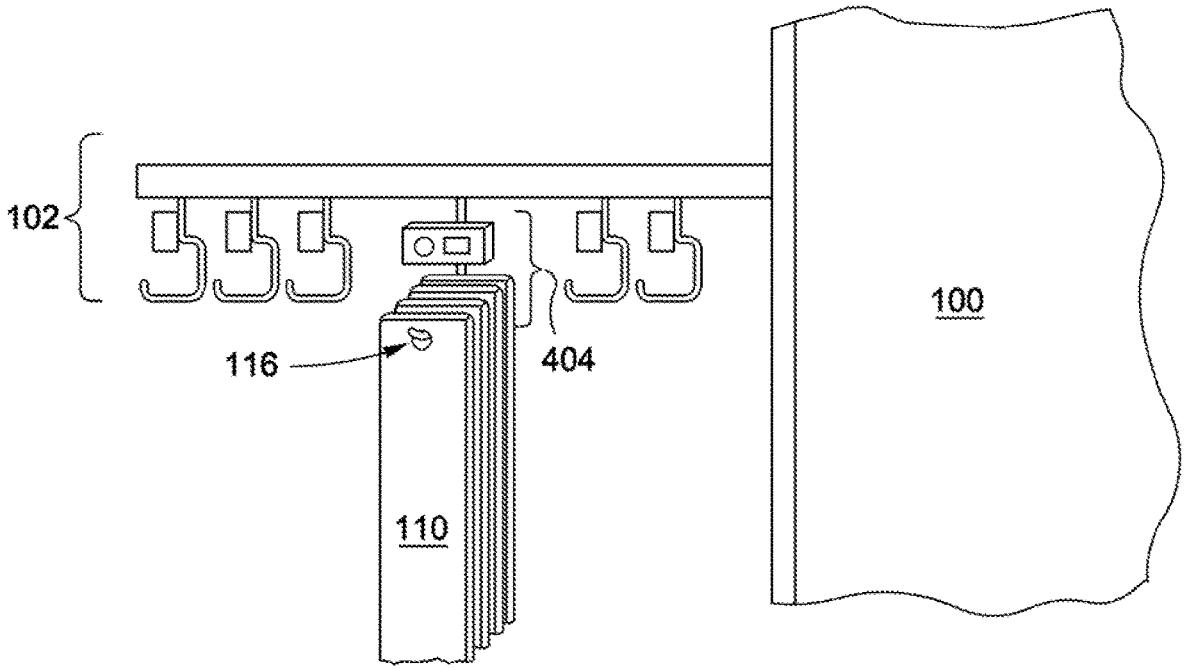
FIG. 4D illustrates the hanging drawer slide of FIGS. 4A-4C in a different configuration.

FIG. 4D illustrates the hanging drawer slide 102 of FIGS. 4A-4C in a different configuration. Specifically the hook assembly 404 uses a different hook 116 that is configured to hang several items 110. Allowing the use of single item hooks 116 and multiple item hooks 116 provides a user with the option to group together items 110 based on their frequency of use, such as by hanging more frequently dispensed items on a single hook 110. The hook assembly 404 is rotated (as seen in FIG. 4D) in order to facilitate access to the items 110 and to the item inventory device 114. The hook assembly 404 can be rotated in either direction (e.g., clockwise or counterclockwise) to dispense and track items 110 from either side of the cabinet 100. Users can select various configurations of hook assemblies 404 based on need, taking into account, for example, item size, type, and frequency of use.

Figure 5:
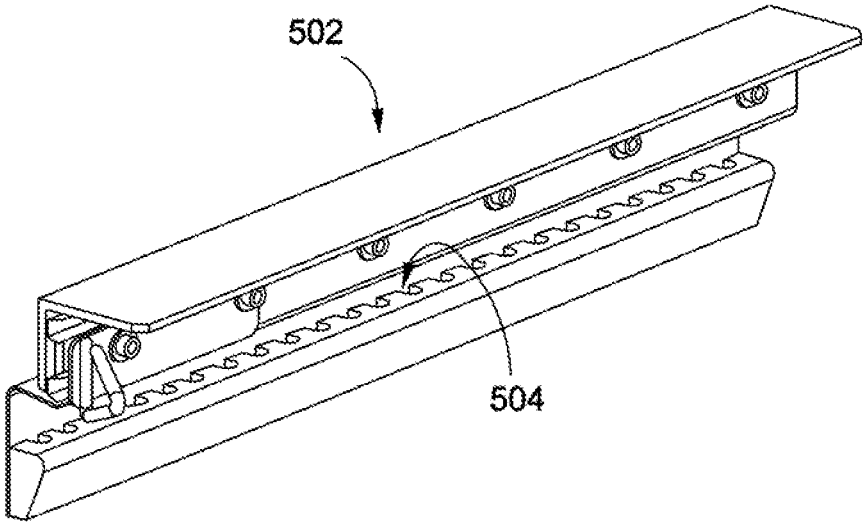
FIG. 5 illustrates another hanging drawer slide according to certain embodiments.

FIG. 5 illustrates another hanging drawer slide 502 according to certain embodiments. Similar to the hanging drawer slide 102 of FIGS. 1-4D, the hanging drawer slide 502 is configured to couple with, and slidably withdraw from, a drawer slide receiving module 202. The hanging drawer slide 502 includes hook detents 504 configured to be removably coupled to hooks 116 of the various types discussed above.

Figure 6A:
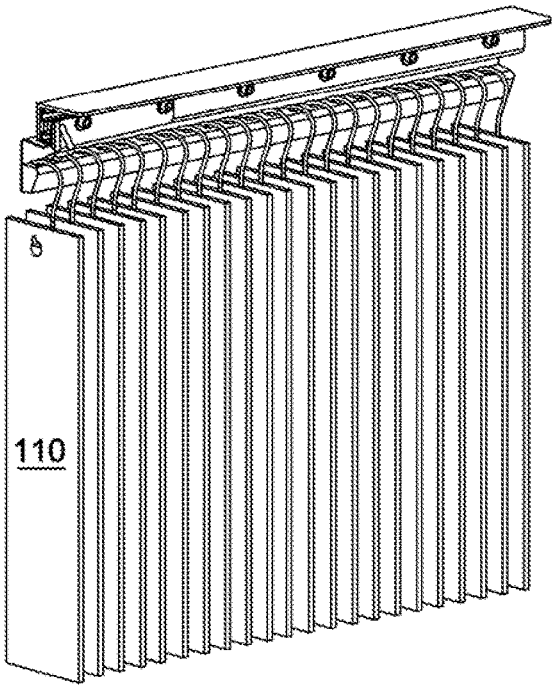
FIGS. 6A-6D illustrate the hanging drawer slide of FIG. 5 in various configurations.
Figure 6B:
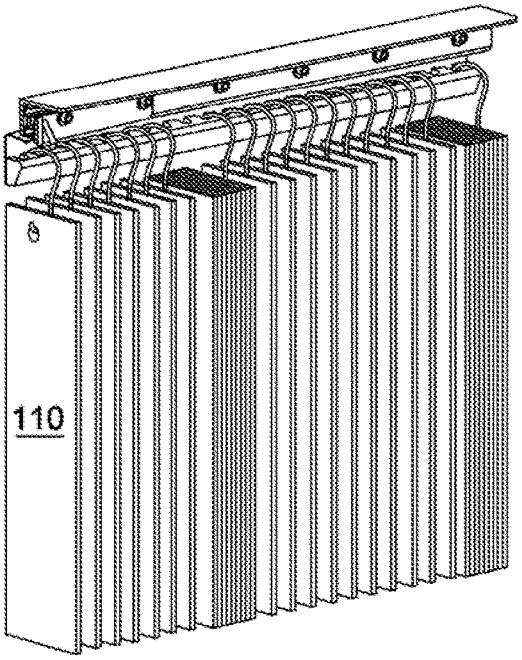
Figure 6C:
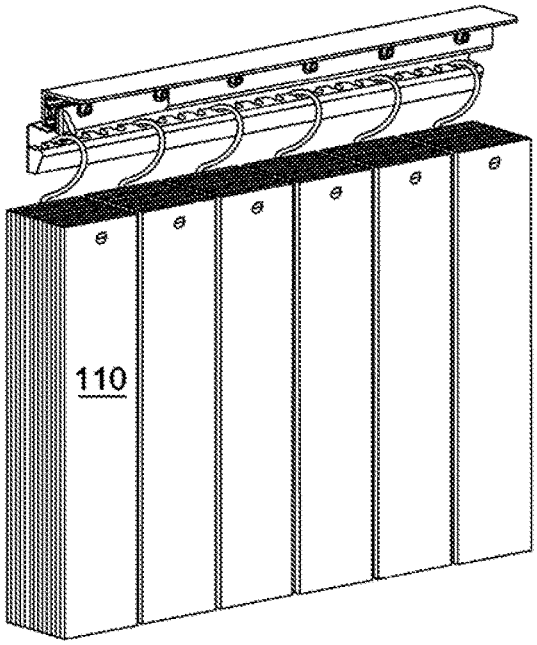
Figure 6D:
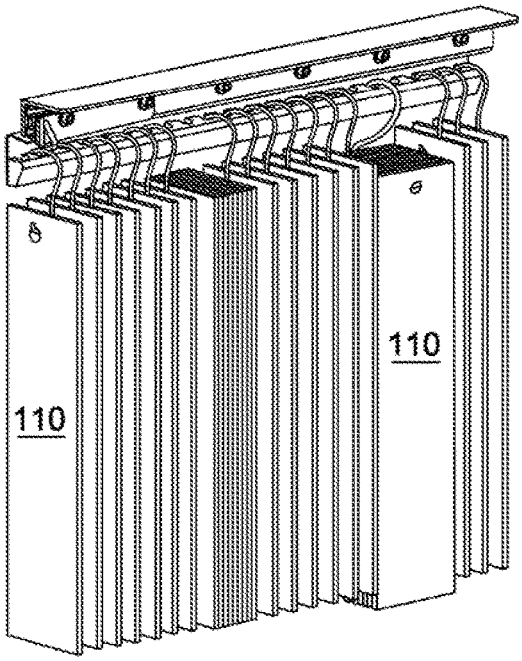

FIGS. 6A-6D illustrate the hanging, drawer slide 502 of FIG. 5 in various configurations. FIG. 6A illustrates the hanging drawer slide 502 having hook detents 504 coupled to single-item, forward-facing hooks 116. FIG. 6B illustrates the hanging drawer slide 502 having hook detents 504 coupled to both single-item, tbrward-facing hooks 116 and multiple-item, forward-facing hooks 116. FIG. 6C illustrates the hanging drawer slide 502 having hook detents 504 coupled to multiple-item, side-facing hooks 116. FIG. 61) illustrates the hanging drawer slide 502 having hook detents 504 coupled to single-item, forward-facing hooks 116 multiple-item, forward-facing hooks 116, and multiple-item, side-facing hooks 116.

As discussed above, certain embodiments of the cabinet disclosed herein include drawer slide receiving modules that are configured to be coupled to the cabinet in a variety of configurations. Each of the drawer slide receiving modules is itself configured to couple to either one or many hanging drawer slides or shelf drawer slides in a variety of configurations. The ability to configure the cabinet with drawer slide receiving modules, hanging drawer slides, and shelf drawer slides in a variety of configurations allows for the efficient storage and dispensing of items of different sizes and types.

While certain aspects and embodiments of the invention have been described, these have been presented by way of example only, and are not intended to limit the scope of the invention. Indeed, the novel methods and systems described herein may be embodied in a variety of other forms without departing from the spirit thereof. The accompanying claims and their equivalents are intended to cover such forms or modifications as would fall within the scope and spirit of the invention,

What is claimed is:

1. A cabinet comprising:

a plurality of drawer slide receiving modules;

a plurality of hanging drawer slides, each hanging drawer slide coupled to one of the plurality of drawer slide receiving modules, each hanging drawer slide comprising a plurality of hooks, wherein:

a first hook includes:

a first mating portion to connect with a first hook detent on the hanging drawer slide at a first end of the first hook; and a first horizontal portion on a second end of the first hook opposite the first end of the first hook, wherein a first width of the first horizontal portion accommodates one item; and a second hook includes:

a second mating portion to connect with a second hook detent on the hanging drawer slide at a first end of the second hook; and a second horizontal portion on a second end of the second hook opposite the first end of the second hook, the second horizontal portion having a second width larger than the first width, and wherein the second width accommodates at least two items; and a plurality of detents arranged on an inner surface of the cabinet, wherein:

at least one of the plurality of hanging drawer slides is configured to be withdrawn from the cabinet laterally along a horizontal axis of the hanging drawer slide, the plurality of drawer slide receiving modules is configured to be coupled to the cabinet in a first position using a first arrangement of the plurality of detents and coupled to the cabinet in a second position using a second arrangement of the plurality of detents, wherein coupling of one of the plurality of drawer slide receiving modules in the first position includes coupling to at least one detent included in the plurality of detents by at least one projection of the drawer slide receiving module, the entirety of each projection extending downward away from a surface of the drawer slide receiving module at an acute angle relative to the surface of the drawer slide receiving module, and each of the plurality of hooks is configured to be coupled at the first end of the hook below one of the plurality of hanging drawer slides, and wherein a second end of the hook is configured to receive an item for hanging on the hook; and each of the plurality of hooks includes:

a radio frequency identification antenna configured to receive a radio frequency identification signal from a tag in the item for hanging on each of the plurality of hooks; and a processor coupled to a network and configured to determine an inventory of items based on the radio frequency identification signal.

2. The cabinet of claim 1, wherein the plurality of hanging drawer slides is configured to couple to at least one of the plurality of drawer slide receiving modules.

3. The cabinet of claim 1, further comprising:

a shelf drawer slide coupled to one of the plurality of drawer slide receiving modules, the shelf drawer slide configured to hold a plurality of items.

4. The cabinet of claim 3, wherein the shelf drawer slide is configured to be withdrawn from the cabinet in a perpendicular direction along a horizontal axis of the shelf drawer slide.

5. The cabinet of claim 1 further comprising an item inventory device physically coupled to each hanging drawer slide, the item inventory device configured to receive a manual input from a user when the item stored in the hanging drawer slide has been dispensed or added, to indicate that a battery of the item inventory device is low, and to wirelessly communicate with a processor to update a quantity of the item in an item inventory.

6. The cabinet of claim 5, further comprising at least a second item inventory device coupled to one of the plurality of hooks.

7. The cabinet of claim 1, wherein at least one of the plurality of hooks is configured to rotate.

8. A method for configuring a cabinet comprising:

selecting a configuration from a plurality of detents disposed along an inner wall of the cabinet;

coupling a plurality of drawer slide receiving modules to the cabinet in a first position using a first arrangement of the plurality of detents by coupling at least one projection of each drawer slide receiving module with a corresponding detent in the cabinet, according to the configuration selected, wherein coupling of one of the plurality of drawer slide receiving modules in the first position includes coupling to at least one detent included in the plurality of detents by the entirety of at least one projection of the drawer slide receiving module extending downward away from a surface of the drawer slide receiving module at an acute angle relative to the surface of the drawer slide receiving module;

coupling, in the first arrangement, a plurality of hanging drawer slides to the plurality of drawer slide receiving modules, each hanging drawer slide coupled to one of the plurality of drawer slide receiving modules, each hanging drawer slide comprising a plurality of hooks;

configuring an inventory device physically coupled to each hanging drawer slide to receive, a radio frequency identification signal from a tag in an item for hanging on each of the plurality of hooks and to determine an inventory of items based on the radio frequency identification signal;

withdrawing a shelf drawer slide from the cabinet in a perpendicular direction along a horizontal axis;

uncoupling at least one of the plurality of hanging drawer slides from at least one of the plurality of drawer slide receiving modules; and coupling, in a second arrangement, the at least one of the plurality of hanging drawer slides to one of the plurality of drawer slide receiving modules, wherein:

the plurality of drawer slide receiving modules are configured to be removably coupled to the cabinet in a plurality of different configurations, each of the plurality of removable hooks is configured to be removably coupled at a first end of the removable hook below one of the plurality of hanging drawer slides, and a second end of the removable hook is configured to receive an item for hanging on the removable hook, wherein a first hook includes:

a first mating portion to connect with a first hook detent on the hanging drawer slide at a first end of the first hook; and a first horizontal portion on a second end of the first hook opposite the first end of the first hook, wherein a first width of the first horizontal portion accommodates one item; and a second hook includes:

a second mating portion to connect with a second hook detent on the hanging drawer slide at a first end of the second hook; and a second horizontal portion on a second end of the second hook opposite the first end of the second hook, the second horizontal portion having a second width larger than the first width, and wherein the second width accommodates at least two items.

9. The method of claim 8, further comprising coupling the plurality of hanging drawer slides with at least one of the plurality of drawer slide receiving modules.

10. The method of claim 8, further comprising coupling the shelf drawer slide to one of the plurality of drawer slide receiving modules, the shelf drawer slide configured to hold a plurality of items.

11. The method of claim 8, further comprising configuring an item inventory device further comprises configuring the item inventory device physically coupled to each hanging drawer slide to receive a manual input from a user when the item stored in the hanging drawer slide has been dispensed, to indicate that a battery of the item inventory device is low, and to wirelessly communicate with a processor to update the inventory of items.

12. The method of claim 11, further comprising coupling a second item inventory device with one of the plurality of hooks.

13. The method of claim 8, further comprising determining a third arrangement of the cabinet based on the plurality of drawer slide receiving modules, at least one of the plurality of hanging drawer slides and the shelf drawer slide.

14. The method of claim 8, further comprising configuring at least one of the plurality of hooks to rotate.

15. The method of claim 8, further comprising configuring at least one of the plurality of hooks to slide laterally along a horizontal axis of the hanging drawer slide.

* * * * *